US008889977B1

(12) United States Patent
Gage et al.

(10) Patent No.: US 8,889,977 B1
(45) Date of Patent: Nov. 18, 2014

(54) ELECTRICAL PICKUP FOR STRINGED MUSICAL INSTRUMENT

(71) Applicants: David Rowland Gage, New York, NY (US); Richard Ned Steinberger, Nobleboro, ME (US)

(72) Inventors: David Rowland Gage, New York, NY (US); Richard Ned Steinberger, Nobleboro, ME (US)

( * ) Notice: Subject to any disclaimer, the term of this patent is extended or adjusted under 35 U.S.C. 154(b) by 0 days.

(21) Appl. No.: 14/133,316

(22) Filed: Dec. 18, 2013

Related U.S. Application Data

(60) Provisional application No. 61/848,003, filed on Dec. 20, 2012.

(51) Int. Cl.
*G10H 3/14* (2006.01)

(52) U.S. Cl.
USPC ..... 84/731; 84/730; 84/732

(58) Field of Classification Search
USPC ..... 84/730–732
See application file for complete search history.

(56) References Cited

U.S. PATENT DOCUMENTS

| | | | | | |
|---|---|---|---|---|---|
| 2,570,701 | A * | 10/1951 | Martin | 333/20 |
| 4,378,721 | A * | 4/1983 | Kaneko et al. | 84/731 |
| 4,852,443 | A * | 8/1989 | Duncan et al. | 84/733 |
| 5,123,326 | A * | 6/1992 | Clevinger | 84/743 |
| 5,262,585 | A * | 11/1993 | Greene et al. | 84/645 |
| 5,537,906 | A * | 7/1996 | Steinberger | 84/291 |
| 6,244,422 | B1 * | 6/2001 | Bai | 198/464.4 |
| 6,457,864 | B1 * | 10/2002 | Chang et al. | 384/9 |
| 6,515,214 | B2 * | 2/2003 | Takabayashi | 84/731 |
| 7,019,206 | B2 * | 3/2006 | Mishima | 84/723 |
| 7,034,218 | B1 * | 4/2006 | Lazarus et al. | 84/723 |
| 7,196,261 | B2 * | 3/2007 | Suenaga | 84/730 |
| 7,218,032 | B2 * | 5/2007 | Kim | 310/323.17 |
| 7,268,291 | B2 * | 9/2007 | Urbanski | 84/731 |
| 7,323,632 | B2 * | 1/2008 | Wachter | 84/730 |
| 7,655,857 | B2 * | 2/2010 | Yoshino et al. | 84/723 |
| 8,696,405 | B2 * | 4/2014 | Duescher | 451/11 |
| 8,740,668 | B2 * | 6/2014 | Duescher | 451/11 |
| 8,754,318 | B2 * | 6/2014 | Mori | 84/723 |
| 2005/0011342 | A1 * | 1/2005 | Fishman | 84/730 |
| 2007/0080951 | A1 * | 4/2007 | Maruyama et al. | 345/173 |
| 2009/0324174 | A1 * | 12/2009 | Kwan et al. | 385/52 |
| 2011/0223835 | A1 * | 9/2011 | Duescher | 451/28 |
| 2012/0118130 | A1 * | 5/2012 | Field | 84/730 |
| 2013/0047826 | A1 * | 2/2013 | Wissmuller | 84/723 |

* cited by examiner

*Primary Examiner* — David S. Warren
(74) *Attorney, Agent, or Firm* — Saul Epstein

(57) ABSTRACT

An electric pickup for stringed musical instruments for installation on a bridge that includes height-adjusting wheels for adjusting string height. The pickup includes three piezo-electric sensing elements symmetrically arranged around the adjuster stud, and the entire downward force generated by the strings and coupled to the instrument face through the bridge is borne by the piezo-electric elements.

5 Claims, 4 Drawing Sheets

ELECTRICAL PICKUP FOR STRINGED MUSICAL INSTRUMENT

RELATED APPLICATION

This application claims the benefit under 35 USC §119(e) of the filing date of U.S. Provisional Patent Application No. 61/848,003 entitled "The Lifeline", filed Dec. 20, 2012.

BACKGROUND OF THE INVENTION

Electric pickups used in connection with "acoustic type" stringed musical instruments have been in use for many years. Indeed, the present inventors have previously co-invented and patented two different designs that are in common use today (U.S. Pat. No. 6,018,120, and U.S. Pat. No. 8,455,749). Others have also designed and patented various configurations.

SUMMARY OF THE INVENTION

The present invention is designed for use with instruments that use a bridge having a string height adjustment mechanism in each leg (i.e., height adjustment wheels). Generally, this means the larger stringed instruments, such as the upright bass. There is no actual limit on size of the present invention; the preceding comment arising merely because smaller instruments ordinarily do not use adjustment wheels. While the invention is expected to find its primary use as described above, it is not so limited, and the invented pickup can also be used in connection with other bridge types. Accordingly, the example shown herein with the invention installed on an upright bass bridge with adjuster wheels should be taken as illustrative, and not limiting.

Depending on the type of adjustment mechanism used (there are currently two general types in use, as will be explained below), the invented pickup fits and is clamped between the adjusting wheel and either (1) the bridge foot or (2) the bridge leg. The pickup can be installed on either the bass or treble side of the bridge, but is more commonly installed on the bass side. The pickup, which includes three piezo-electric elements connected in parallel, bears substantially the entire force that is transmitted from the strings, through the bridge, to the instrument face on the selected side. The term "piezo-electric element" as used herein refers to an element fabricated from any one of a number of materials that generates a voltage between its faces when subjected to compression. Such elements are common in the industry, and need not be further described.

The three piezo-electric elements, as installed on an instrument, are arranged at the apexes of an equilateral triangle, i.e., a substantially symmetrical disposition around the adjuster screw. The static loads on the elements are approximately equal. The "tripod" support configuration provides a very stable base for the forces transmitted downward through the bridge. Unintended asymmetries in installation and adjustment may create some differences, but such differences are not believed to be significant in terms of affecting performance.

DETAILED DESCRIPTION OF THE INVENTION

Figure 1:
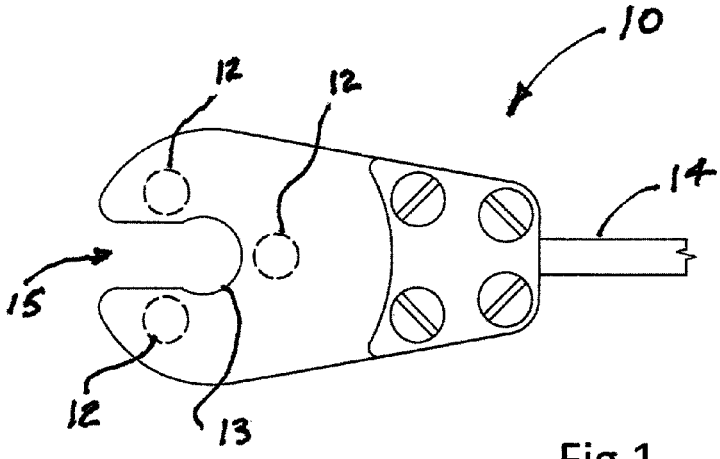
FIG. 1 is a top view of a presently preferred embodiment of the invention, with the locations of the three piezo-electric elements indicated by dashed lines.
Figure 2:
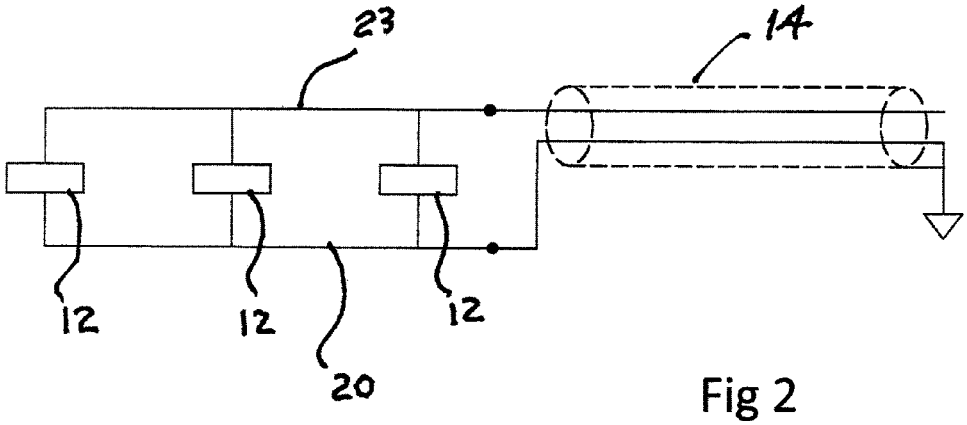
FIG. 2 is a schematic diagram showing the electrical circuit of the invention.

FIG. 1 illustrates a top view of a presently preferred embodiment of the invention, designated by the numeral 10. The invented pickup 10 includes three piezo-electric compression sensors 12 arranged symmetrically around an opening 13 that extends through the pickup. Slot 15 allows the pickup to be installed on the bridge adjusters without having to completely remove the bridge from the instrument. The three sensors are shown as dashed lines in FIG. 1 since they are not actually visible from the outside of the pickup. In the presently preferred embodiment of the invention, the sensors 12 are about 0.180 inches in diameter, and about 0.030 inches thick. Different sized sensors may, of course, be used if desired. As seen in the connection diagram of FIG. 2, the three sensors 12 are connected in parallel to cable 14, which carries the combined signal to amplifying and reproducing means, not shown, located elsewhere. While FIG. 2 is a schematic diagram, hot foil 23 and ground foil 20 are identified thereon for clarity. FIG. 2 shows a two wire shielded cable, but persons of skill in the art will understand that a single conductor shielded cable could be used as well, with the shield connected to the ground foil 20. The connections between the cable conductors and the ground and hot foils may be made by soldering, welding, or other means as is convenient.

Figure 3:
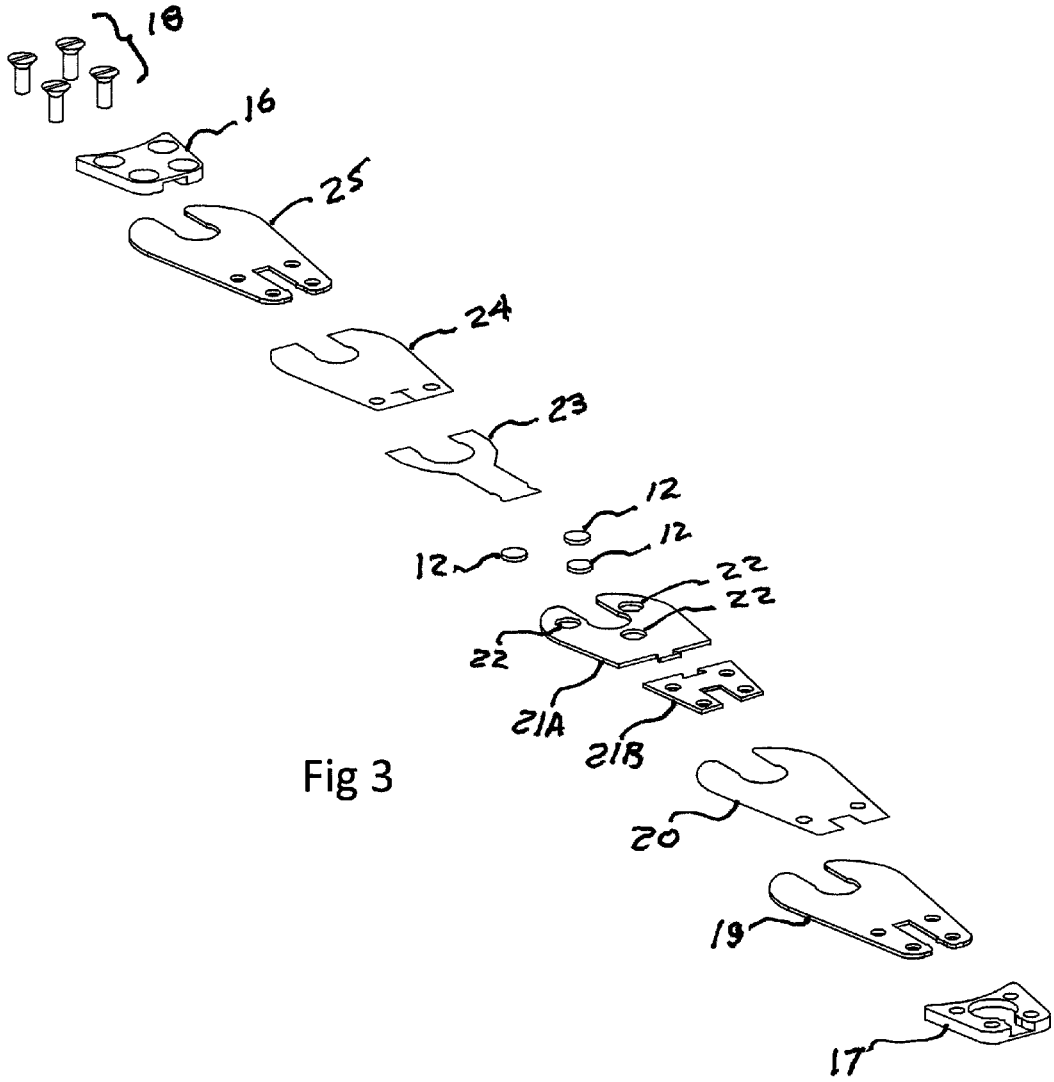
FIG. 3 is an exploded view of the presently preferred embodiment of the present invention (not including the cable).

The invented pickup is a sandwich of parts, as can be seen in the exploded view of FIG. 3, held together between top cap 16 and bottom cap 17 by screws 18. The terms "top" and "bottom", as used herein, are used for descriptive convenience only inasmuch as the invented pickup can be installed with either side "up", with no difference in performance. The caps are preferably fabricated from aluminum, but other materials can be used if desired. The parts may be finished (or not) as desired, such as by paint or anodizing or using other finishes.

Adjacent bottom cap 17, is bottom plate 19, which is preferably fabricated from stainless steel, but other materials may also be used, if desired. Bottom plate 19 (and the top plate 25, which will be described below) may be used to provide stiffness to the assembly and therefore, in such case, should be relatively heavy. The plates, particularly top plate 25, also provide electrical shielding for the pickup. The plate parts in the preferred embodiment are about 0.030 inches thick. If mechanical stiffness is not deemed important, thinner plates may be used. Also, it is preferred that the plates be bent slightly inward before assembly to keep the assembly from "opening up".

Ground foil 20, preferably made of copper or brass, rests on bottom plate 19. The term "foil" is used herein for convenience, since the preferred embodiment of the invention uses metal a few thousandths thick, however, the actual conductor thickness used can be whatever is convenient. Pliant spacer 21A rests on the ground foil, and has three openings 22 to position and retain the piezo-electric elements 12. Pliant spacer 21A is preferably fabricated from plastic foam sheet having about the same thickness as the sensors, i.e., in the preferred embodiment about 0.030 inches. Rigid spacer 21B is placed adjacent to the pliant spacer 21A (between the caps 16 and 17). Rigid spacer 21B is preferably made of fiberboard or the like, and also has a thickness about the same as the sensors. The sensors rest on ground foil 20, in the openings 22.

Hot foil 22 lays on top of spacer 21, and makes contact with the upper surfaces of the sensors 12. Paper insulating sheet 24 covers hot foil 23, and insulates it from top plate 25.

Top plate 25 and top cap 16 complete the sandwich, which, as previously noted, is held together by screws 18 threaded into bottom cap 17. Depending on how the caps are finished, it may be necessary to remove the finish in some area(s) so that electrical contact (for shielding purposes) can be maintained between top cap 16, top plate 25, bottom plate 19, and bottom cap 17. Bottom and top plates 19 and 25 are preferably unfinished stainless steel.

Figure 4:
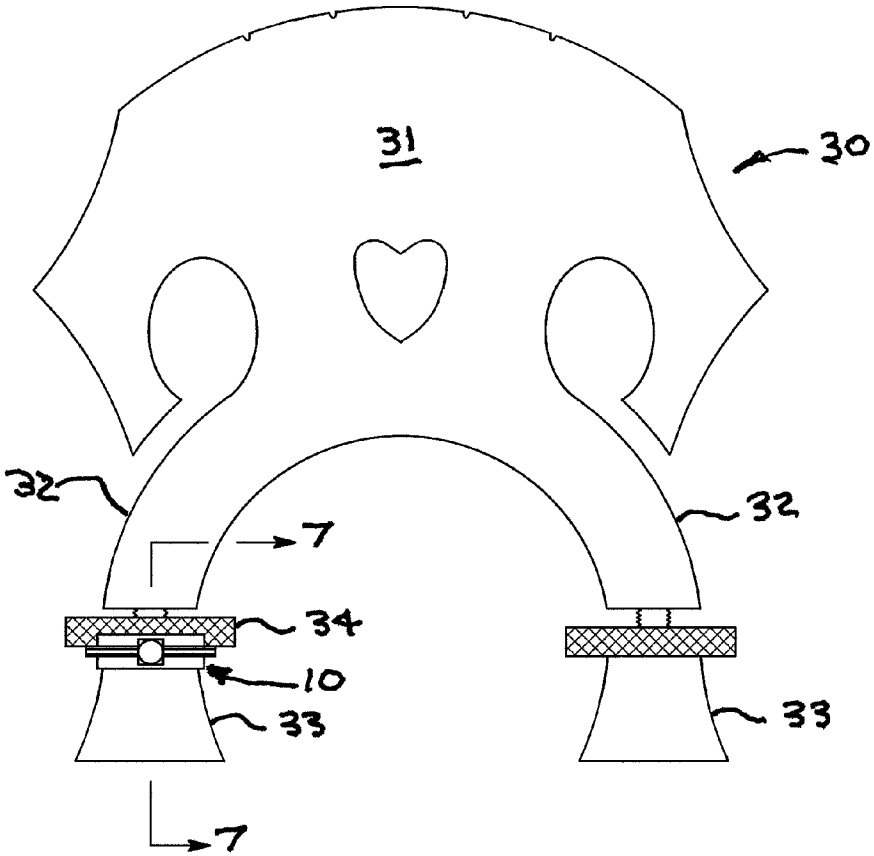
FIG. 4 is a rear view of a musical instrument bridge (i.e., looking from the instrument tail) with an exemplar of the embodiment of the invention as shown in FIG. 1 installed on the bass side.
Figure 5:
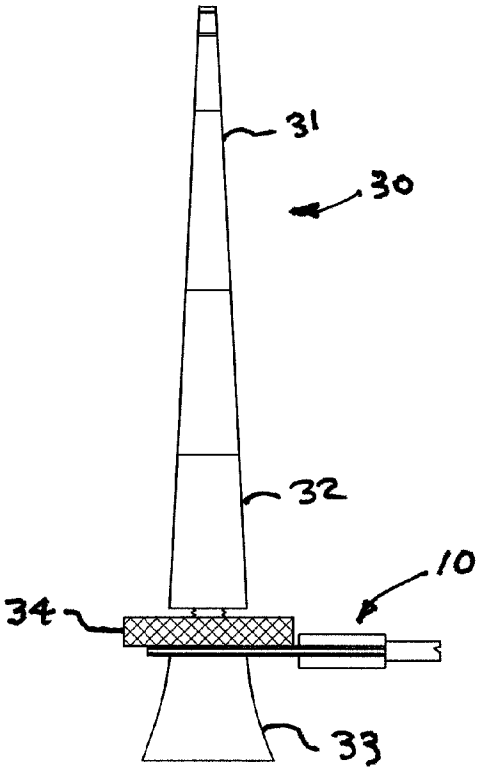
FIG. 5 is a left side view of the bridge of FIG. 4.

FIGS. 4 and 5 are a rear and left side view of a typical bridge 30, as might be used on an upright bass, with an exemplar of the present invention 10 installed on the bass side. The bridge includes a body 31 that has two legs 32 and two feet 33. The bridge also includes two adjusters that are each comprised of an adjuster wheel 34 and a threaded stud 35. The top ends of the studs (which are not ordinarily threaded) are typically pressed or glued into holes in the bridge legs, which keeps the studs from turning when the wheels are adjusted. The adjuster wheels, which are threaded onto the studs, are used to adjust the height of the bridge to its desired height. The studs extend into clearance holes in the feet 33. As can be seen in FIG. 5, the left adjuster wheel presses against the pickup such that the downward force generated by the strings is exerted on the pickup that is resting on foot 33.

Figure 7B:
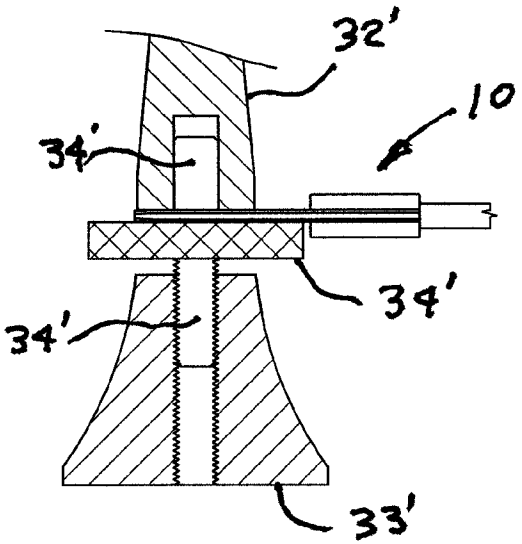
FIG. 7B is a view similar to FIG. 7A but depicting a bridge using a second type of adjusting wheel for string height adjustment.
Figure 7A:
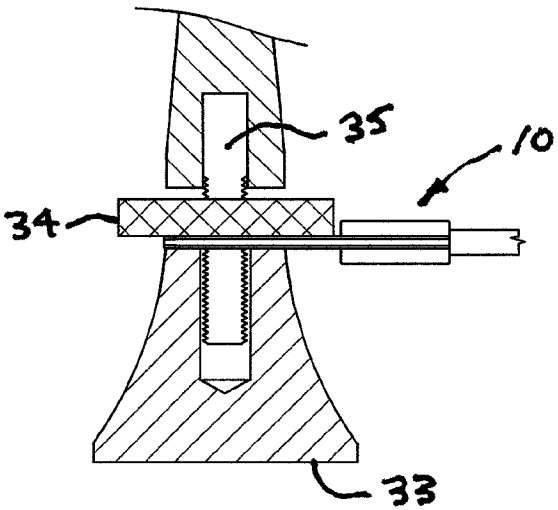
FIG. 7A is a partial cross section of the bridge shown in FIG. 4, taken at 7-7 of FIG. 4.
Figure 6:
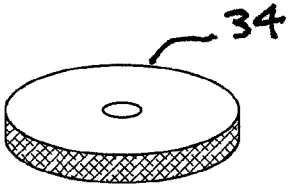
FIG. 6 is a trimetric view of an adjusting wheel such as is commonly used on bridges suitable for use with the present invention.

There is another type of adjusting mechanism in common use wherein the adjusting wheel and the stud are combined as one piece, and the threads on the stud mate with internal threads in the bridge foot, with the top portion of the stud being a slip fit into the bridge leg. FIG. 7B is a sectioned view similar to FIG. 7A except that the second type of adjusting mechanism, just described, is installed. In this type of adjusting mechanism, the wheel and the stud (including the threaded and unthreaded portions) are one piece, as indicated in the FIG. 7B by having all three portions numbered the same (34'). The unthreaded top part of the stud is a slip fit into a hole in the leg 32', and the lower threaded portion is threaded into a tapped hole in the foot 33'. When using this second type of adjustment mechanism, the pickup is installed above the adjustment wheel instead of below it, but otherwise the operation is the same.

Since the piezo-electric elements 12 are symmetrically disposed about opening 13, they form a very stable support for the bridge leg. The use of three equally spaced transducers makes it easy to locate the array such that the forces on all three are substantially equal whereby all three contribute substantially equal portions of the total pickup output. Equalizing transducer loading is important both from transducer life and performance points of view. Using three transducers, as opposed to two or four, makes equalization easier.

Placing the pickup in the bridge leg, relatively close to the strings, results in a more percussive, articulated sound output from the amplifier. This effect is highly desirable, especially when amplifying an instrument during a "live" presentation. Placing the pickup in the bridge leg, relatively close to the strings also helps to get a "cleaner", less "fluffy", or a more articulated tone. It has been found, also, that when the total load is substantially evenly shared, there is a significant reduction of the possibility of an intermittent popping" sound.

We claim:

1. An electric pickup for stringed musical instruments, which comprises a sandwich including:

a ground conductor having a first opening therein;

a hot conductor having a second opening therein, said first and second openings being substantially aligned;

three piezo-electric elements located between and electrically connected to said ground conductor and said hot conductor, said three piezo-electric elements being disposed substantially symmetrically around said openings.

2. An electric pickup as recited in claim 1 and further including a slot in each of said ground conductor and said hot conductor extending from said openings to the peripheries of said ground conductor and said hot conductor.

3. An electric pickup as recited in claim 1 and further including first and second shield plates located external of said sandwich including said ground conductor and said hot conductor, said first and second shield plates being electrically connected to said ground conductor, but insulated from said hot conductor, said first and second shield plates each having an opening therein substantially aligned with said openings in said hot and ground conductors.

4. An electric pickup as recited in claim 3 and further including a slot in each of said ground conductor, said hot conductor, and said first and second shield plates extending from said openings to the peripheries of said ground conductor, said hot conductor, and said first and second shield plates.

5. An electric pickup as recited in claim 1 and further including a plastic foam spacer with three openings therein to retain said three piezo-electric elements in their substantially symmetric positions with respect to said openings in said ground and hot conductors.

* * * * *